United States Patent [19]

Bhagat

[11] Patent Number: 5,055,879

[45] Date of Patent: Oct. 8, 1991

[54] APPARATUS FOR OZONELESS EFFICIENT CHARGING OF A PHOTORECEPTIVE DRUM IN AN ELECTROPHOTOGRAPHIC PRINTER

[75] Inventor: Gopal C. Bhagat, Houston, Tex.

[73] Assignee: Compaq Computer Corporation, Houston, Tex.

[21] Appl. No.: 360,371

[22] Filed: Jun. 2, 1989

[51] Int. Cl.[5] ..... G03G 15/02

[52] U.S. Cl. ..... 355/219; 361/225

[58] Field of Search ..... 355/219; 361/225, 221; 430/902

[56] References Cited

U.S. PATENT DOCUMENTS

| | | | |
|---|---|---|---|
| 3,172,024 | 2/1965 | Gundlach | 361/225 |
| 4,727,453 | 2/1988 | Ewing | 355/219 X |
| 4,761,709 | 8/1988 | Ewing | 361/225 |

FOREIGN PATENT DOCUMENTS

| | | | |
|---|---|---|---|
| 58-194061 | 11/1983 | Japan | 355/219 |
| 63-208878 | 8/1988 | Japan | 355/219 |
| 1-35464 | 2/1989 | Japan | 355/219 |

*Primary Examiner*—Joan H. Pendegrass

*Attorney, Agent, or Firm*—James R. Burdett

[57] ABSTRACT

An apparatus is provided that controls the distribution of charge on the surface of a photoreceptor drum in an electrophotographic printer while reducing the ozone output over that of a standard corotron. The apparatus includes an electrically conductive shaft coated with a semiconductive material disposed longitudinally parallel to the photoreceptor drum. The shaft and semiconductive material are biased into contact with the photoreceptor drum via spring mounted bearings. Thus, rotation of the photoreceptor drum drives the shaft and semiconductive material to rotate about its longitudinal axis.

6 Claims, 2 Drawing Sheets

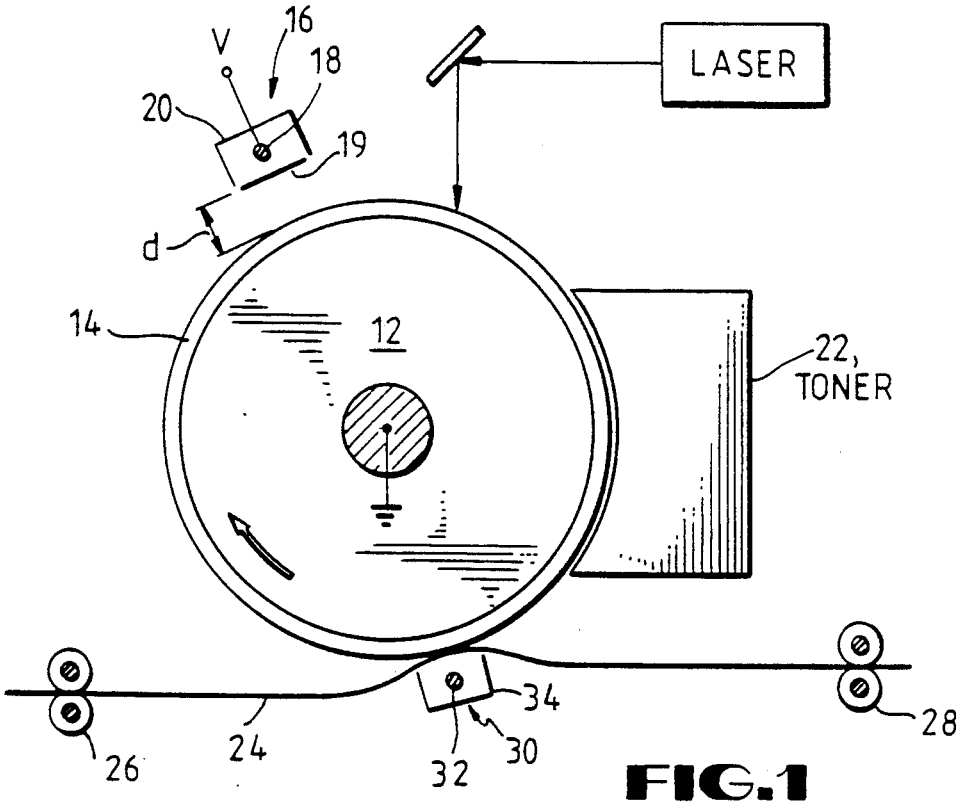
FIG.1
(PRIOR ART)
FIG.2
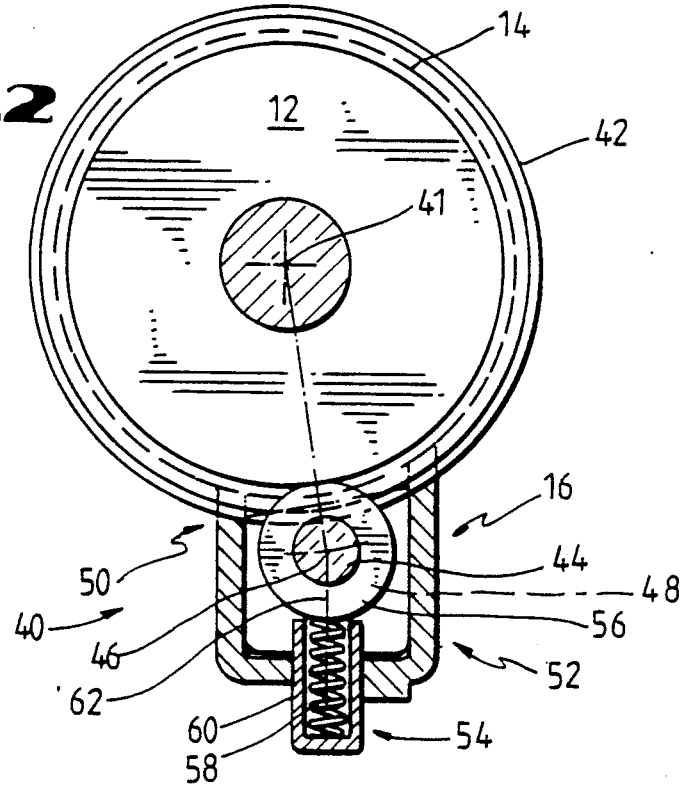

APPARATUS FOR OZONELESS EFFICIENT CHARGING OF A PHOTORECEPTIVE DRUM IN AN ELECTROPHOTOGRAPHIC PRINTER

BACKGROUND OF THE INVENTION

1. Field of the Invention

This invention relates generally to a method and apparatus for controlling the charging of a photoreceptor drum or belt in a duplicator, such as a xerographic copier and an electrophotographic printer and, more particularly, to a charge applying semiconductive tube or roller that rotates in unison and contact with the photoreceptor drum or belt.

2. Description of the Related Art

Duplicators, such as electrophotographic printers and Xerographic copiers have heretofore employed a corona charging means that typically uses a corona wire disposed longitudinally parallel to a photoreceptor drum and spaced a constant distance from the outer periphery of the drum. This corona wire typically has an approximately 5,000 volt charge of appropriate polarity impressed thereon to initiate ion propagation of the appropriate polarity to the photoreceptive surface of the drum. While this method is generally effective for distributing positive or negative charges on the surface of photoreceptive material, it suffers from several inherent shortcomings, which are more pronounced when the propagating ions are of negative polarity.

For example, since the corona wire is non-contacting and spaced a small distance from the photoreceptive drum, relatively large voltages must be impressed upon the corona wire to ensure uniform and complete deposition of positive or negative ions on the surface of the photoreceptive drum. Moreover, the presence of oxygen in the region between the corona wire and the photoreceptive drum results in the oxidation of ionized air, which produces significant amounts of ozone.

Office equipment employing this technology, such as desktop laser printers and copiers, are typically operated in an office environment that includes numerous people in close contact with the equipment. Ozone is believed by some persons to have a significant deleterious impact upon the respiratory system of people who are exposed to the ozone for prolonged periods of time. Previous laser printers have employed carbon impregnated cardboard filters in an attempt to counteract the dispersion of ozone. These filters, however, have been generally ineffective in significantly reducing ozone levels.

Further, the air space between the corona wire and the photoreceptive drum is a less efficient transmission medium of charged ions than, for example, semiconductive material. Accordingly, significantly high voltages are necessary to ensure a dense and uniform deposition of positive charges on the surface of the photoreceptive drum. This high voltage requirement necessitates the construction of large, expensive power supplies, which has a significant impact on the overall cost of relatively cost sensitive laser printers.

The present invention is directed to an apparatus for efficiently depositing a uniform electrical charge, positive or negative, on the surface of a photoreceptive drum of an electrophotographic printer at a significantly reduced charge applying voltage without reducing print quality and while reducing the production of ozone.

SUMMARY OF THE INVENTION

The primary object of the present invention is to provide a duplicator that advantageously reduces the level of ozone production when compared with duplicators known in the art.

Another object of the present invention is to provide a duplicator that efficiently uses power and produces dark, crisp, and accurate prints.

Yet another object of the present invention is to provide a duplicator that employs a charge roller rotating in contact and unison with the photoreceptive drum.

To obtain these and other objectives, an apparatus is provided for uniformly distributing an electrical charge on a circumferential surface of a photoreceptive drum in a duplicator. The photoreceptive drum has a longitudinal axis about which it is rotated. The apparatus includes an electrically conductive shaft having a longitudinal axis extending substantially parallel and adjacent the photoreceptive drum. Further, the electrically conductive shaft is adapted for connection to a source of electric voltage. A tube of semiconductive material extends about and connects to the electrically conductive shaft. The apparatus also includes means for rotating the electrically conductive shaft and tube of semiconductive material about their longitudinal axes.

In another aspect of the instant invention, an apparatus is provided for uniformly distributing an electric charge on an outer circumferential surface of a photoreceptive drum in a duplicator. The photoreceptive drum has a longitudinal axis about which it is rotated. The apparatus includes an electrically conductive shaft having a longitudinal axis extending substantially parallel to and adjacent said photoreceptive drum. The electrically conductive shaft is also adapted for connection to a source of electric voltage. A tube of semiconductive material extends about and connects to the electrically conductive shaft. The apparatus further includes means for rotatably mounting the shaft and tube immediately adjacent the photoreceptive drum so that an outer circumferential surface of the tube of semiconductive material contacts the outer circumferential surface of the photoreceptive drum and is rotated by rotation of the photoreceptive drum.

BRIEF DESCRIPTION OF THE DRAWINGS

Other objects and advantages of the invention will become apparent upon reading the detailed description and upon reference to the drawings in which:

FIG. 1 is a schematic representation in end view of a prior art electrophotographic printer;

FIG. 2 is an end view of one embodiment of the apparatus of the present invention relative to the photoreceptor drum.

Figure 3:
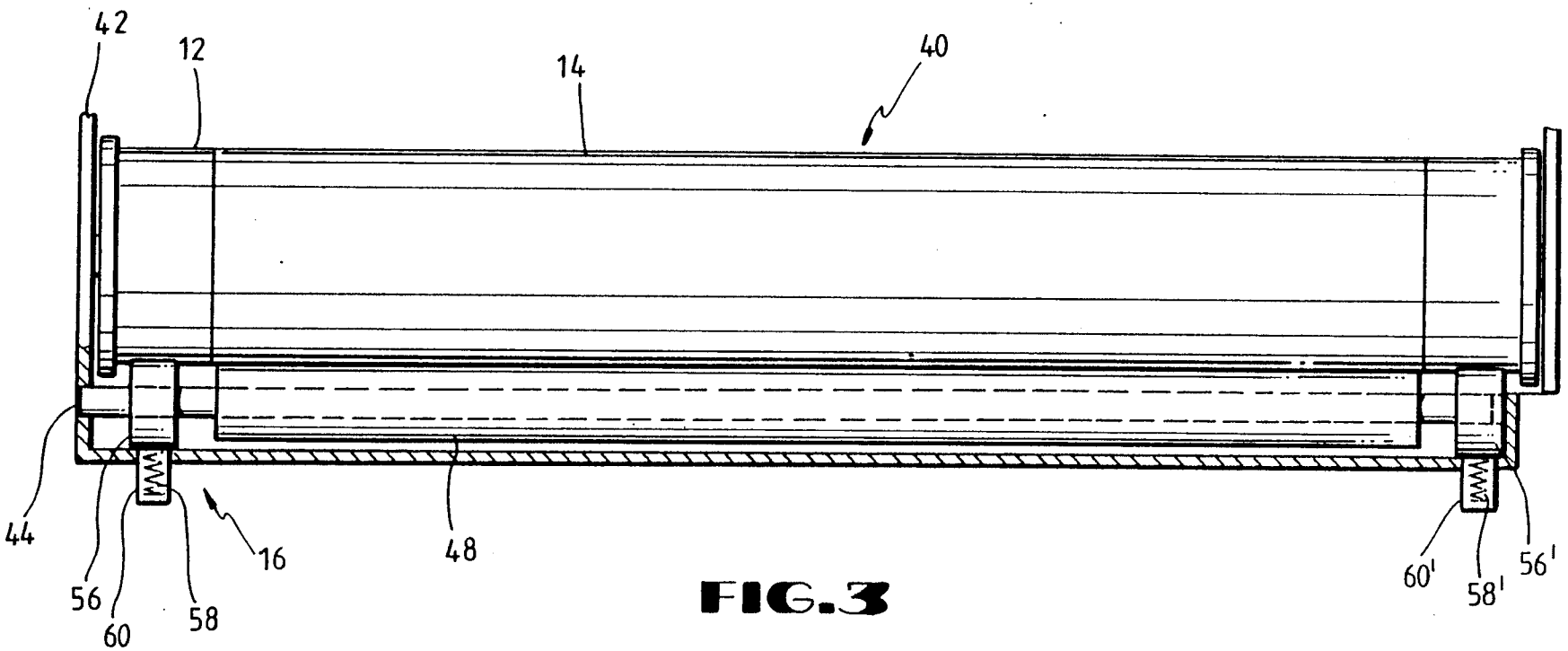
FIG. 3 is a top view of one embodiment of the apparatus of the present invention relative to the photoreceptor drum.

While the invention is susceptible to various modifications and alternative forms, a specific embodiment thereof has been shown by way of example in the drawings and is herein described in detail. It should be understood, however, that the embodiment illustrated herein is not intended to limit the invention to the particular form disclosed, but, on the contrary, the intention is to cover all modifications, equivalents, and alternatives falling within the spirit and scope of the invention as defined by the appended claims.

DESCRIPTION OF THE PREFERRED EMBODIMENT

In order to properly appreciate the instant invention, it is useful to first review the general operation of previous electrophotographic printers and, in particular, the means and method for negatively charging the photoreceptor drum. The operation of Xerographic copiers is substantially similar, with some differences in the polarity of the electrical charge applied to the photoreceptor drum. The instant invention is readily applicable to both Xerographic copiers and electrophotographic printers, such as desktop laser printers.

Turning now to the drawings and referring first to FIG. 1, a side view of a functional, schematic representation of an electrophotographic printer 10 is shown. An electrically conductive drum 12 is rotated in a clockwise direction about a longitudinal axis 13 by, for example, an electric motor (not shown). The drum 12 is connected to electrical ground and has a coating 14 of a photosensitive material, such as an organic photoconductor.

Photoconductive material ordinarily acts as an insulator but conducts when exposed to a source of light. Therefore, any electrical charge present on the exterior surface of the photoconductor tends to remain unless that area of the drum is exposed to a light source. For example, in the event of exposure to light, that exposed section of the photoconductive coating 14 conducts and thereby directs the charge through the photoconductive coating 14 and drum 12 to system ground, thereby eliminating any electrical charge present on that exposed portion of the photoconductive drum 12.

This general principle of operation is employed in electrophotographic printers. A corotron 16 is disposed adjacent the exterior surface of the photoconductive coating 14 of the drum 12 and operates to uniformly deposit negative ions on the photoconductive coating 14.

The corotron 16 includes an electrically conductive wire 18 disposed generally parallel to the longitudinal axis 13 of the drum 12 and spaced a distance "d" from the surface of the coating 14. The wire 18 is connected to a source of negative electrical voltage (i.e., approximately −5000 V). This high voltage is necessary to ensure sufficient and uniform ion distribution on the surface of the coating 14 because of the extent of the spacing and resultant low efficiency of ion transmission from the wire 18 to the coating 14. Further, the high voltage necessitates the use of an RFI shield 20 disposed about the wire 18 to reduce the transmission of radio frequency noise. It is also desirable to mount a grid 19 and electrically bias the grid 19 to an appropriate voltage level to stabilize the ion emission and provide uniform ion deposition on the drum 12.

As the drum 12 rotates beneath the corotron 16, a uniform coating of negative ions is disposed on the surface of the coating 14. These negative ions remain unchanged on the surface of the coating 14 unless the coating 14 is exposed to a source of light. Accordingly, it should be appreciated that selective introduction of light onto the coating 14 produces patterns of negative ions.

The source of light is, of course, a laser that is selectively operated to discharge the negative ions on the portions of the drum 12 that correspond to the image portions of the desired print. Accordingly, the laser light produces the desired patterns on the surface of the coating 14 where the image portion contains no charge and the non-image portion is highly negatively charged. The pattern of negative charges remaining on the coating 14 are a negative mirror-image of the desired printer output.

Xerographic copiers operate slightly differently, in that a +5000 V electrical signal is applied to the corotron 16, resulting in the deposition of positive ions on the surface of the drum 12. Unlike the negative ions, these positive ions tend to attract the negatively charged toner particles. Accordingly, the desired pattern of positive images corresponds to a positive mirror-image of the desired copier output.

Further, rather than a laser, Xerographic copiers employ an intense white light reflected off of an original sheet of paper that is to be copied as the light source. Clearly, light reflects well from those areas of the original that do not contain lines, letters, or other dark markings; however, light reflects poorly from those areas that contain the lines, letters, or other dark markings that are to be copied.

Thus, it should be apparent that the areas of the coating 14 that are exposed to the well reflected light are rendered conductive and pass the positive charge to system ground. Conversely, those areas of the coating that receive the poorly reflected light retain their insulative properties and thereby preserve the positive charge on the surface of the coating 14. Accordingly, the pattern of positive charges remaining on the coating 14 are a positive mirror-image of the original sheet of paper.

Referring again to the electrophotographic printer of FIG. 1, as the drum 12 continues to rotate, it transports the negatively charged pattern through a toner bin 22, which contains corresponding negatively charged toner particles. The negatively charged toner particles are repelled by the highly negatively charged non-image patterns on the surface of the coating 14. Thus, the surface of the coating 14 now contains a loose toned image, which is a positive mirror-image of the desired print.

At the next stage of the printing process of the electrophotographic printer of FIG. 1, the loose toner, positive mirror-image of the desired print is transferred to a clean sheet of paper 24. The sheet of paper 24 is transported in close proximity to the drum 12 via pairs of pinch rollers 26, 28, which are driven by, for example, an electric motor (not shown).

The paper 24 travels in synchronism with the drum 12 at a substantially tangential path adjacent the surface of the coating 14, and the toner is transferred to the paper 24 via a transfer corotron 30. The corotron 30 is disposed on the opposite side of the paper from the drum 12 so that positive ions produced by the corotron 30 attract the negatively charged toner particles from the surface of the coating 14 toward the corotron 30. The sheet of paper 24, however, intercepts the toner particles so that the paper 24 now contains a loose toner, positive image of the original sheet of paper. The toner particles are subsequently fused to the paper 24 by a heating process (not shown).

Like the corotron 16, the transfer corotron 30 includes an electrically conductive wire 32 disposed generally parallel to the longitudinal axis 13 of the drum 12 and spaced a distance "d" from the surface of the coating 14. The wire 32 is also connected to a source of high electrical voltage (i.e., approximately +5000 V). This high voltage necessitates the use of an RFI shield 34 disposed about the wire 32 to reduce the transmission of radio frequency noise.

After the toner is transferred to the paper 24, the surface of the coating 14 usually contains some residual toner that was not transferred to the paper 24. Accordingly, a number of techniques are employed to ensure that the coating 14 is cleaned of toner and remaining electrical charges. Electrophotographic printers and Xerographic copiers typically employ various mechanical wipers (not shown) to remove residue toner, as well as an additional light source to remove any remaining electrical charges.

The problems associated with the use of the wire corotron 16 are mentioned in the background section of the specification. The instant invention is directed to overcoming or minimizing these previously mentioned problems.

Accordingly, referring simultaneously to FIGS. 2 and 3, end and top views of one embodiment of an apparatus 40 of the present invention are respectively shown. To the extent possible, elements illustrated in FIGS. 2 and 3 that are common to FIG. 1 are assigned common element numbers to enhance the identity of elements and to aid in the understanding of the operation of the instant invention.

The apparatus 40 uniformly distributes an electric charge on the circumferential surface of a photoreceptive drum in a duplicator, such as an electrophotographic printer or a Xerographic copier. The photoreceptive drum 12 is electrically conductive and is rotated in a clockwise direction about its longitudinal axis 41 by an electric motor (not shown). The drum 12 is connected to electrical ground and has a coating 14 of a photosensitive material, such as an organic photoconductor. The entire apparatus 40 is contained within a housing 42 that is preferably constructed of an organic plastic.

The noncontacting wire corotron 16 of previous duplicators is replaced by an electrically conductive shaft 44 having a longitudinal axis 46 extending substantially parallel to and adjacent the photoreceptive drum 12. The electrically conductive shaft 44 is adapted for connection to a source of electric voltage. However, since the shaft 44 is rotated, there is no direct electrical connection and a slip ring arrangement is provided to achieve indirect electrical connection.

A tube of semiconductive material 48 extends about and connects to the electrically conductive shaft 44. Thus, electric voltage applied to the conductive shaft 44 propagates through the tube of semiconductive material 48 to the surface of the drum 12, thereby applying a positive electric charge to the surface of the photoreceptive drum 12.

It is significant to note that since ion propagation occurs through the semiconductive material 48, air is not exposed to the high voltage applied to the shaft 44. Accordingly, ionized oxygen is not formed, and ozone production is drastically reduced or eliminated. Preferably, the semiconductive material 48 has a volume resistivity in the range of $10^3$-$10^6$ ohms-cm and is selected from one of the group of natural rubber, neoprene, etc.

To enhance the uniform distribution of the electrical charge placed on the surface of the drum 12, the shaft 44 and tube of semiconductive material 48 are rotated in peripheral synchronism relative to the drum 12. The apparatus 40 includes means 50 for rotating the electrically conductive shaft 44 and tube of semiconductive material 48 about the longitudinal axis 46 of the shaft 44.

The rotating means 50 includes means 52 for rotatably mounting the shaft 44 and tube 48 immediately adjacent the photoreceptive drum 12 so that an outer circumferential surface 49 of the tube of semiconductive material 48 contacts the outer circumferential surface 51 of the photoreceptive drum 12 and is rotated by rotation of the photoreceptive drum 12. In preferred form, the photoreceptive drum 12 contacts and drives the tube 48 and shaft 44. In particular, clockwise rotation of the drum 12 induces a counterclockwise rotation of the tube 48 and shaft 44.

The mounting means 52 includes means 54 for applying a spring force to the shaft 44 in a direction to urge the tube of semiconductive material 48 into contact with the photoreceptive drum 12. Preferably, the spring force is sufficient to produce a definite elemental nip area on the surface of the semiconductive tube 48. That is to say, the outer periphery of the tube is deformed slightly, forming a longitudinal flat, rectangular area on the peripheral surface of the tube 48.

The spring force applying means 54 includes bearings 56, 56' disposed about the shaft 44 at opposite longitudinal ends thereof and a compression spring 58 disposed against the bearing 56 and adapted for urging the tube of semiconductive material 48 into contact with the photoreceptive drum 12.

The spring 58 is preferably a coil compression spring positioned within a housing 60 that includes a bore 61 having a longitudinal axis 62 substantially intersecting the longitudinal axis 46 of the shaft 44. In this manner, the spring force is efficiently and directly applied to the shaft 44 to prevent misalignment and binding of the shaft 44. Further, the longitudinal bore axis 62 also generally intersects the drum longitudinal axis 41 to similarly insure proper contact between the drum 12 and tube 48.

The force applied by the spring 58 and the durometer of the semiconductive material are selected to provide a relatively slipless connection between the drum 12 and tube 48. The durometer of the tube 48 is sufficient to provide a substantial frictional contact between the tube 48 and photoreceptive surface of the drum 12. Preferably, the durometer is selected to be within the range of 60–70 Shore A, such that the combination of the spring force and the durometer produces a definite elemental nip area at the contact region between the drum 12 and tube 48 having a nip width, in the range of 0.001–0.0015 inch.

It is believed that the apparatus 40 will provide high quality printing at a substantially reduced charging voltage and with little or no production of ozone. For example, rather than the typical −5000 V charging voltage applied to the corotron 16, voltages as low as −1500 V are believed to effectively produce prints of superior quality.

I claim:

1. A duplicator having an apparatus for uniformly distributing a charge on an outer circumferential surface of a photoreceptive drum used in an electrophotographic printer, said photoreceptive drum having a longitudinal axis and being rotated about said longitudinal axis, the apparatus comprising:

an electrically conductive shaft having a longitudinal axis extending substantially parallel and adjacent said photoreceptive drum, said electrically conductive shaft being adapted for connection to a source of electric voltage;

a tube of semiconductive material extending about and connected to said electrically conductive shaft, said semiconductive material having a preselected durometer; and means for rotatably mounting said shaft and tube immediately adjacent said photoreceptive drum and urging said shaft and tube in a direction toward said photoreceptive drum with a preselected force so that an outer circumferential surface of said tube of semiconductive material contacts said outer circumferential surface of said photoreceptive drum and is rotated by rotation of said photoreceptive drum, said preselected force and the durometer of said semiconductive material interacting to form a definite elemental nip area in said tube of semiconductive material, said nip area having a width in the range of 0.001 to 0.0015 inches.

2. A duplicator, as set forth in claim 1, wherein the preselected durometer of said tube is in the range of 60–70 Shore A.

3. A duplicator, as set forth in claim 1, wherein said semiconductive material has a resistivity in the range of $10^3$–$10^6$ ohms-cm.

4. A duplicator, as set forth in claim 3, wherein said semiconductive material is selected from one of the group of natural rubber and neoprene.

5. A duplicator, as set forth in claim 1, wherein said mounting means includes means for applying a spring force to said shaft in a direction to urge said tube of semiconductive material into contact with said photoreceptive drum.

6. A duplicator, as set forth in claim 5, wherein said spring force applying means includes a bearing disposed about the shaft and a compression spring disposed against said bearing and adapted for urging said tube of semiconductive material into contact with said photoreceptive drum.

* * * * *